United States Patent [19]

Abel et al.

[11] Patent Number: 4,837,558

[45] Date of Patent: Jun. 6, 1989

[54] GLASS BREAK DETECTOR

[75] Inventors: William E. Abel, Portland, Oreg.; Douglas H. Marman, Ridgefield, Wash.

[73] Assignee: Sentrol, Inc., Portland, Oreg.

[21] Appl. No.: 108,284

[22] Filed: Oct. 13, 1987

[51] Int. Cl.[4] ..... G08B 13/04

[52] U.S. Cl. ..... 340/550; 310/324; 340/566

[58] Field of Search ..... 340/550, 566; 310/324, 310/321

[56] References Cited

U.S. PATENT DOCUMENTS

| | | | |
|---|---|---|---|
| 3,863,250 | 1/1975 | McCluskey, Jr. | 340/550 |
| 4,088,989 | 5/1978 | Solomon | 340/550 |
| 4,091,660 | 5/1978 | Yanagi | 340/550 |
| 4,134,109 | 1/1979 | McCormick et al. | 340/550 |
| 4,196,423 | 4/1980 | Carver et al. | 340/550 |
| 4,668,941 | 5/1987 | Davenport et al. | 340/550 |

*Primary Examiner*—Glen R. Swann, III

*Attorney, Agent, or Firm*—Chernoff, Vilhauer, McClung & Stenzel

[57] ABSTRACT

A glass break defection system includes a unidirectional acoustic transducer directed toward an area of glass to be monitored. The transducer is narrowband and has a sharp frequency response peak in the 4 to 8 kHz range. An electronic audio discriminator connected to the transducer output is responsive to signals within this frequency range having a predetermined amplitude thereby eliminating ambient or environmental sounds not characteristic of breaking glass. The transducer is mounted in a rectangular enclosure which is pointed at the area to be monitored and comprises a flat circular metallic disk affixed to the enclosure with a piezo electric element affixed to the rear of the metallic disk. The enclosure is tuned to resonate at a frequency characteristic of the sound of breaking glass.

15 Claims, 2 Drawing Sheets

ALARM OUT
LOOP
LOOP
K1
32
+5V
CR1A
LM339
13
U1
DS1
R7
680

LATCHING RELAY
N/C
GOES LOW 3 DAYS AFTER LATCHING ALARM
WATCHDOG TIMER
LOOP TIMING
C1
.047
30
U3
COP413L
S1
L3
L2
L1
L0
CK1
CK2
RESET
L4
L5
L6
L7
S0
SK
G0
G1
G2
C5
100PF
5%
C6
.047
R2
10K
C2
.001
28
R3
1M 1%
R4
8.25K
1%
R5
56K
R6
560K
CR1B
LED LATCH
16 COUNT
64 COUNT
128 COUNT
40MV
DC
OPTIONAL
TRIM
RES
R1
10K
PIEZO
C4
68
6V
U2
LM2931
C3
.047
34
DC+
DC−

GLASS BREAK DETECTOR

FIELD OF THE INVENTION

The following invention relates to an acoustic sensor system for use in an alarm system which detects the sound of breaking glass and rejects other ambient or environmental sounds.

BACKGROUND OF THE INVENTION

Many security installations include sensors for detecting the breaking of glass which may occur as a result of an unauthorized intrusion into a secure area. These sensors and their associated circuitry generally fall into two classes. First, some sensors are physically attached to the glass that is to be monitored. Examples of such systems are shown in the U.S. Pat. Nos. to Yanagi 4,091,660 and McCluskey 3,863,250. These systems usually involve audio discriminators in the nature of mechanical filters to remove acoustic energy which is not within the spectrum of the sounds made by breaking glass. For example, McClusky utilizes layers of material interposed between the glass and the surface of a piezoelectric element which filter acoustic vibrations which are not characteristic of breaking glass. Since such sensors are mounted directly to the glass to be monitored, they may be defeated if the glass can be cut and the leads connecting the sensor to the remainder of the alarm system can be cut. Also, despite their filtering, such sensors can react to impacts on the glass which do not break it and which are caused by animals, flying debris, or the like.

Other sensing systems utilize broad band microphones which "listen" for the sound of breaking glass. These microphones usually have a wide bandwidth, and electronic filtering is incorporated to discriminate between the sound of breaking glass and other sounds that may be similar. For example, the McCormick et al., U.S. Pat. No. 4,134,109 includes timing and filtering circuits to process the signals from the microphones so that only breaking glass is detected. The theory of the McCormick et al patent is that there will be two sounds separated by a timing interval. If a window or door is to be monitored, the glass will shatter when struck and will shatter again as it hits the floor. The audio discriminator is designed to listen for this sequence of events.

However, not all installations include hard floors where two distinct shattering sounds may be heard. In such cases attempts have been made to provide audio discriminators which tune to the frequency of breaking glass. According to the Yanagi patent, breaking glass has a frequency peak at approximately 50 kilocycles. Many conventional audio discriminator circuits tune for the sound of breaking glass in the 25,000- to 50,000-cycle range. In the past this has led to a high incidence of false alarms because many ordinary environmental or household sounds have frequency components or harmonics in the 25,000- to 50,000-cycle range. For example, the sound made by the jangling of keys on a key chain will usually activate most glass break detector systems of this type. This is unacceptable because of the number of false alarms which can be generated by such ordinary sounds.

SUMMARY OF THE INVENTION

The present invention is a glass break detection system which includes an acoustic transducer having a unidirectional response pattern which may be pointed in the direction of an area of glass to be monitored. The transducer is mounted in a tuned enclosure for producing a frequency response peak in the range between 4,000 and 8,000 Hz and has an output connected to an audio discriminator which performs further filtering and is also selectively responsive to audio signals of sufficient magnitude in the 4,000 to 8,000 Hz range.

The transducer may be any conventional type of acoustic pickup, but is preferably a piezoelectric element affixed to the rear of a metal disk. The disk may be mounted in an enclosure which is tuned to have a high Q value within the aforementioned range. The piezoelectric element itself may have a resonance peak within this range, and in combination with the enclosure, provides a very selective response to frequencies centered around 6,000 Hz..

The audio discriminator includes a threshold detector with built-in hysteresis for detecting the occurrence of sounds which are loud enough to provide a signal at the output of the transducer exceeding a preset voltage threshold. A counter is connected to the output of the threshold detector and counts the number of output pulses from the threshold detector which occur within a preset period of time. This electronically limits the response of the system to sounds having a predetermined minimum amplitude, and which are within a given frequency range. The threshold detector also includes a hysteresis circuit which eliminates spurious high frequency noise. If the counter counts 32 output pulses from the threshold detector within a period of 40 milliseconds, an output switch is closed which activates an alarm.

The transducer can be mounted in any type of convenient fixture which may point it at the area of glass to be monitored. For example, it may be convenient to use a ceiling fixture mounted some distance away from the area with the transducer pointed downwardly toward a window or glass door.

It is a principal object of this invention to provide a glass break detector having a highly selective frequency response for monitoring the occurrence of breaking glass without being susceptible to false alarms.

A further object of this invention is to provide a glass break detector which can be conveniently mounted some distance away from the area of glass to be monitored so that it can be pointed at the area without the necessity of being physically attached to a pane of glass.

A still further object of this invention is to provide a glass break detection system having a narrow band acoustic transducer coupled to an audio discriminator for filtering all sounds except those characteristic of breaking glass.

The foregoing and other objectives, features and advantages of other present invention will be more readily understood upon consideration of the following detailed description of the invention taken in conjunction with the accompanying drawings.

DETAILED DESCRIPTION OF THE INVENTION

Figure 2:
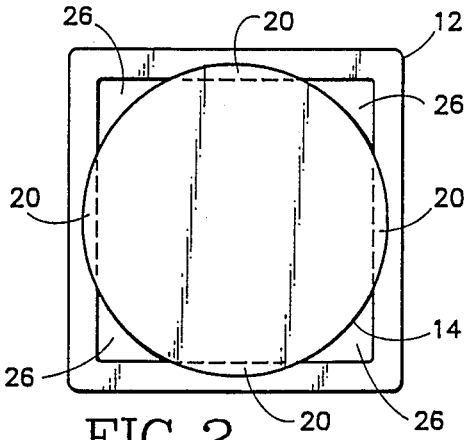
FIG. 2 is a front view of an acoustic transducer mounted in an enclosure of a type which may be used in the fixture of FIG. 1.
Figure 1:
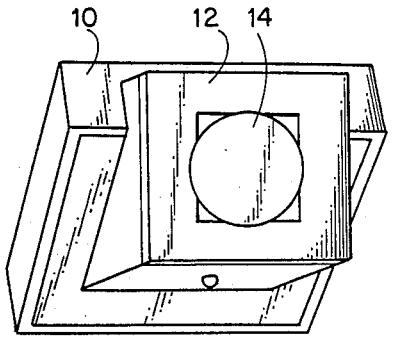
FIG. 1 is a perspective view of a ceiling mounted acoustic transducer of the type used in the system of the present invention.
Figure 3:
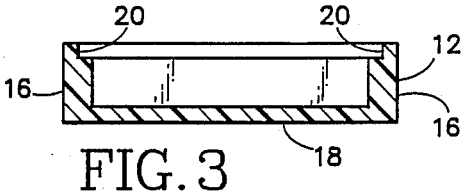
FIG. 3 is a side cutaway view of the enclosure for holding the transducer shown in FIG. 2.
Figure 4:
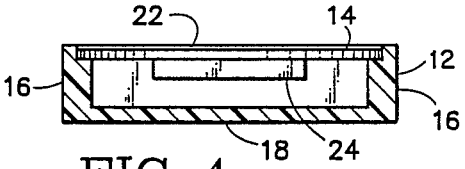
FIG. 4 is a side cutaway view of the transducer mounted in the enclosure of FIG. 2.

Referring to FIG. 1, a housing 10 which is adapted to be mounted to a ceiling or wall with screws or the like (not shown) contains an acoustic enclosure 12 which holds an acoustic transducer 14. As seen in FIG. 3, the enclosure 12 is a relatively shallow rectangular enclosure including sidewalls 16 and a rear wall 18. Portions of the sidewalls 16 have arcuate cutouts 20 (FIGS. 2 and 4) in order to receive the transducer 14. The arcuate cutouts 20 provide lip portions which may support the transducer 14 at four points along its outer periphery. As seen in FIG. 4, the transducer 14 comprises a metal disk 22 having a piezoelectric element 24 affixed to the rear thereof. Suitable electric leads (not shown) extend through the rear wall 18 of enclosure 12 and are connected to an audio discriminator to be described below. The metal disk 22 is glued to the lips formed by the cutouts 20, and thus covers most of the front of the enclosure 12 except for four substantially triangular ports 26 (FIG. 2).

The transducer 14 has a nominal response peak at approximately 6.3 kHz. The enclosure 12 is designed to provide a very sharp response peak at approximately 6 kHz. The "Q" value of the enclosure 12 is such that the transducer has a 1000 cycle bandwidth; that is, at 500 cycles off of the center frequency, the transducer response will be down by 3 db. Peaking the response at about 6000 cycles is accomplished through the interior dimensions of the enclosure 12 and the size of the ports 26. Also, the dimensions of the transducer 14 are chosen so that the disk 22 has a diameter which is one-fourth the wave length of the transducer's nominal frequency.

The frequency of 6000 cycles as a center frequency for a narrowband transducer was chosen as a result of spectrum analysis of the acoustic energy generated by breaking glass. It has been found experimentally that at 6000 cycles there is a very high signal-to-noise ratio between breaking glass and other environmental sounds such as telephones ringing or dogs barking. Depending upon the particular application and the room acoustics, however, the center frequency could shift as much as 2000 cycles in either direction, and therefore a range of between 4000 and 8000 cycles is suggested as the center frequency of a transducer for this application.

The ceiling mounting 10 enables the transducer 14 and its enclosure 12 to be located some distance away from the glass to be monitored. The mounting 10 is secured so that the transducer 14 points at the specific area under surveillance. To "point" in this context means that the plane of the disk 22 is normal to the line of sight between the transducer and the area of glass to be monitored.

Figure 7:
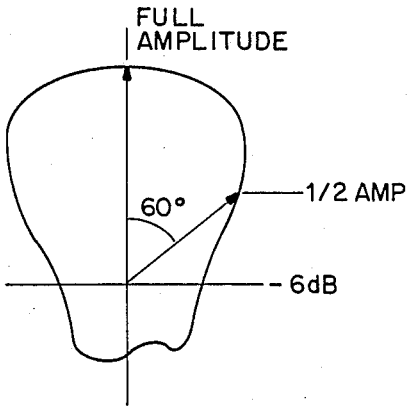
FIG. 7 is a polar pickup response pattern for the transducer and enclosure of FIG. 1.

The way in which the disk 22 is mounted in the enclosure 12 makes the response of the transducer unidirectional. FIG. 7 shows a typical polar pickup response pattern for the transducer 14 as mounted in the enclosure 12. At 60° off axis, the response of the transducer is down 3 db from its on-axis peak. This directionality provides further discrimination between the sound of interest, which is breaking glass, and other ambient or environmental sounds.

Figure 5:
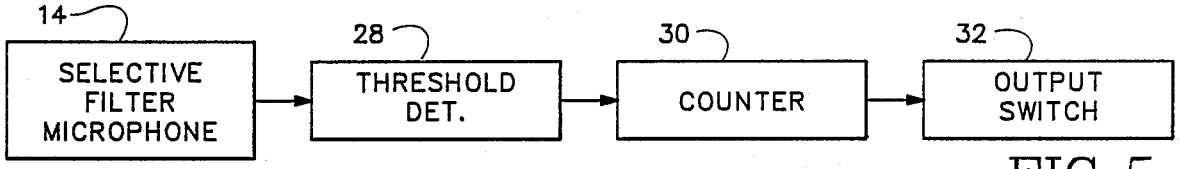
FIG. 5 is a block schematic diagram of the glass break detection system of the present invention.
Figure 6:
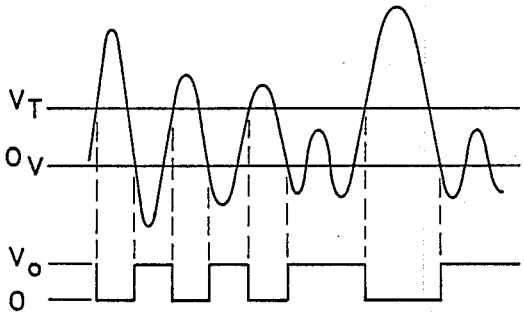
FIG. 6 is a waveform diagram depicting the inputs and output of the threshold detector of FIG. 5.

The schematic diagram of the system, which includes an audio discriminator, is shown in FIG. 5. The transducer 14 has its output connected to a threshold detector 28. FIG. 6 shows the waveform diagrams for the input and output of the threshold detector 28. Whenever the electrical signal from the transducer 14 rises above a preset minimum threshold, labeled $V_t$ in FIG. 6, the output of the threshold detector 28, which is normally high, goes low. The output stays low until the output of the transducer dips below zero volts, at which point the threshold detector output goes high once again until triggered by another pulse above the threshold voltage $V_t$. Connected to the output of the threshold detector 28 is a counter 30 which counts the number of high-to-low transitions that occur within a predetermined time period. When the counter 30 has counted a predetermined number of such pulses within a preset time period it provides an electrical output which triggers alarm switch 32.

Figure 8:
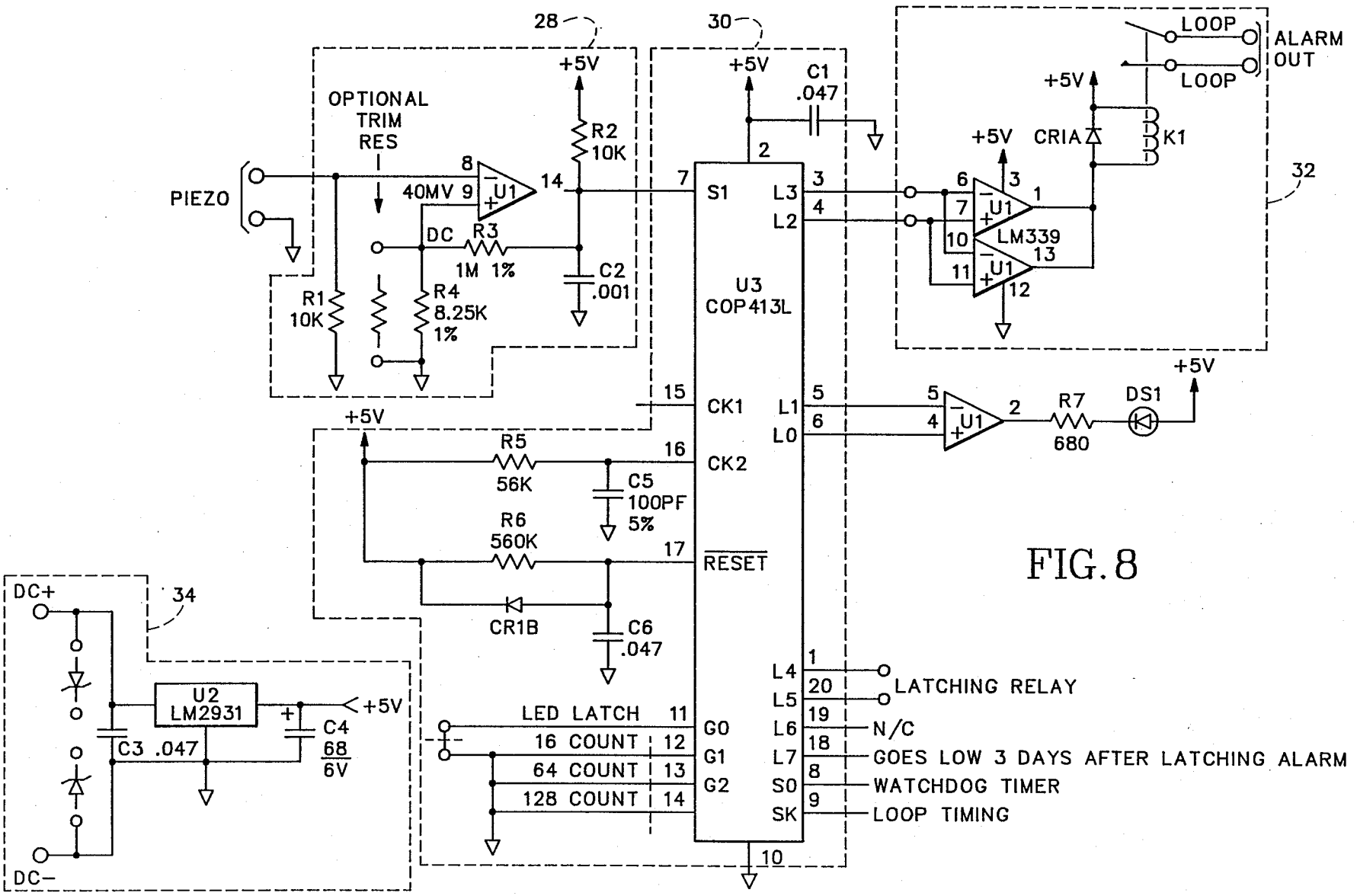
FIG. 8 is a detailed schematic diagram of the system shown in the block diagram of FIG. 5.

A full schematic diagram of the audio discriminator is shown in FIG. 8. The output of the transducer is connected to pin 8 of U1 which is a comparator amplifier array. A 5-volt source is connected to the plus side of the comparator, pin 9 of U1, through R2, R3 and R4. This provides a 40-millivolt threshold setting. Pin 14 of U1 is high as long as the signal on pin 8 remains below 40 millivolts. When pin 8 goes above 40 millivolts, pin 14 goes low. When pin 14 goes low, the voltage on pin 9 drops to zero. Therefore, in order for pin 14 to go high once again, the voltage on pin 8 must drop below the 0-volt level present on pin 9. This provides hysteresis for the threshold detector 28, and thereby prevents high frequency extraneous noise from triggering it. A filter capacitor C2 filters high frequency signals above 10,000 Hz.

The counter 30 is a microprocessor U3 which is programmed to count the number of high to low transitions on pin 7 and to reset after 40 milliseconds. According to the preferred embodiment, 32 transitions must be counted within the 40-millisecond period in order to provide output signals on pins 3 and 4 of U3. The method of programming microprocessor U3 to perform this function is well known in the at. These outputs drive amplifiers in output switch 32 which energize coil K1, opening the relay contacts connected to a closed loop (not shown). The loop may be a conventional closed loop security system in which an alarm is sounded whenever the loop is opened. An oscillator for the microprocessor U3 is provided by R5 and C5. R6, C6 and diode CR1B form a power-up reset circuit for microprocessor U3. The system is powered by a DC power supply 34 which is connected to positive and negative DC supply voltages.

While the configuration of the transducers as shown in FIGS. 1 through 4 is preferred, other transducers or microphones may be used as long as they are acoustically tuned to have a response peak in the range between 4,000 and 8,000 Hz. A piezoelectric element and its enclosure as shown in FIGS. 1 through 4 is preferred because it is relatively inexpensive to manufacture. Moreover, the transducer chosen should be fairly unidirectional so that the transducer will not be sensitive to sounds which are off axis.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A glass break detector comprising:

(a) acoustic transducer means including:

(i) a rectangular enclosure having a rear wall and four shallow sidewalls, each of said sidewalls having an arcuate cut-out portion thereby providing mounting lips;

(ii) a flat circular metallic disk affixed to the respective lip portions of the sidewalls of said enclosure;

(iii) a piezoelectric element affixed to the rear of the metallic disk and (b) signal processing means responsive to an electrical output of said piezoelectric element for providing an alarm when the sound of breaking glass occurs.

2. The glass break detector of claim 1 wherein said flat circular metallic disk is mounted to said respective mounting lips to create ports venting the interior of the enclosure, said ports being located at the four respective corners of said enclosure, thereby tuning said enclosure to resonate at a frequency characteristic of the sound of breaking glass.

3. The glass break detector of claim 2 wherein the flat circular metallic disk has a diameter that corresponds to approximately one-fourth of the wave length of a sound characteristic of breaking glass.

4. The glass break detector of claim 2 wherein said transducer means is mounted in a ceiling fixture and is pointed at an area containing glass to be monitored such that the flat circular metallic disk lies in a plane perpendicular to the line of sight between the ceiling fixture and the area to be monitored.

5. A glass break detector comprising:

(a) acoustic transducer means having a resonant frequency peak at a frequency characteristic of the sound made by breaking glass for providing an electrical output wave form;

(b) threshold detector means responsive to said electrical output wave form for detecting the peaks in said wave form that exceed a nominal predetermined threshold level;

(c) counter means for accumulating a count of said peaks detected by said threshold detector within a predetermined time period and for providing an output signal when a present number of said peaks are counted within said time period; and (d) alarm means responsive to said output signal.

6. The glass break detector of claim 5 wherein said acoustic transducer means is unidirectional.

7. The glass break detector of claim 5 wherein said threshold detector means includes hysteresis means for filtering high frequency noise having amplitudes above said nominal predetermined threshold level.

8. The glass break detector of claim 7 wherein said hysteresis means comprises differential amplifier means having a first input connected to the acoustic transducer means and a second input connected to a source of voltage of a predetermined value, and including a feedback network for causing said second input to go to a low value when the waveform at said first input exceeds said predetermined threshold level, such that the differential amplifier means is not reset until said first input subsequently goes low after exceeding said predetermined threshold level.

9. A glass break detector comprising an acoustic transducer having a substantially unidirectional pickup response pattern mounted so as to point at an area of glass to be monitored, said transducer having a tuned enclosure for producing a frequency response peak between 4 and 8 kHz, said transducer connected to an electronic audio discriminator selectively responsive to signals from the transducer in the 4 to 8 kHz range which have a predetermined threshold amplitude.

10. The glass break detector of claim 9 wherein said acoustic transducer has a 1000 cycle bandwidth.

11. The acoustic transducer of claim 10 wherein the center of the 1000 cycle band width is approximately 6 kHz.

12. The glass break detector of claim 11 wherein said audio discriminator includes a threshold detector responsive to output signal peaks from the acoustics transducer which exceed a predetermined threshold level and a counter for counting the number of such peaks that occur within a predetermined time period.

13. A glass break detector comprising:

(a) acoustic transducer means having a unidirectional response pattern and a resonant frequency response peak at a frequency characteristic of the sound made by breaking glass for providing an electrical output waveform;

(b) threshold detector means responsive to said electrical output waveform for detecting the occurrence of peaks in said waveform exceeding a nominal predetermined threshold level;

(c) counter means for accumulating a count of each occurrence detected by said threshold detector within a predetermine time period and for providing an output signal; and (d) alarm means responsive to said output signal.

14. The glass break detector of claim 13 wherein said threshold detector means includes hysteresis means for filtering high frequency noise having amplitudes above said nominal predetermined threshold level.

15. The glass break detector of claim 14 wherein said hysteresis means comprises differential amplifier means having a first input connected to the acoustic transducer means and a second input connected to a source of voltage of a predetermined value, and including a feedback for causing said second input to go to a low value when the waveform at said first input exceeds said predetermined threshold level, such that the differential amplifier means is not reset until said first input subsequently goes low after exceeding said predetermined threshold level.

* * * * *

UNITED STATES PATENT AND TRADEMARK OFFICE

CERTIFICATE OF CORRECTION

PATENT NO. : 4,837,558

DATED : June 6, 1989

INVENTOR(S) : WILLIAM E. ABEL and DOUGLAS H. MARMAN

It is certified that error appears in the above-identified patent and that said Letters Patent is hereby corrected as shown below:

In the Abstract:

Line 1, change "defection" to --detection--.

Column 2, line 55 change "other" to --the--.

Column 3, line 5 change "inputs" to --input--.

Column 4, line 42 change "high to low" to --high-to-low--.

Column 4, line 48 change "at" to --art--.

Column 6, line 44 change "predetermine" to --predetermined--.

Column 6, line 56 between "back" and "for" insert --network--.

Signed and Sealed this

First Day of September, 1992

*Attest:*

DOUGLAS B. COMER

*Attesting Officer*

*Acting Commissioner of Patents and Trademarks*